US007083295B1

(12) United States Patent
Hanna

(10) Patent No.: US 7,083,295 B1
(45) Date of Patent: Aug. 1, 2006

(54) ELECTROLUMINESCENT BAGS

(75) Inventor: Charles Hanna, Downer's Grove, IL (US)

(73) Assignee: Global Traders and Suppliers, Inc., Chesterton, IN (US)

( * ) Notice: Subject to any disclaimer, the term of this patent is extended or adjusted under 35 U.S.C. 154(b) by 110 days.

(21) Appl. No.: 10/832,212

(22) Filed: Apr. 26, 2004

Related U.S. Application Data

(60) Provisional application No. 60/474,797, filed on May 30, 2003.

(51) Int. Cl.
*F21V 9/16* (2006.01)

(52) U.S. Cl. ..... 362/84; 362/156

(58) Field of Classification Search ..... 362/154, 362/156, 84; 313/500, 502, 511
See application file for complete search history.

(56) References Cited

U.S. PATENT DOCUMENTS

| | | | | |
|---|---|---|---|---|
| 4,864,473 | A * | 9/1989 | Tokarz | 362/490 |
| 4,999,936 | A | 3/1991 | Calamia et al. | 40/544 |
| 5,067,063 | A | 11/1991 | Granneman et al. | 362/156 |
| 5,245,517 | A * | 9/1993 | Fenton | 362/156 |
| 5,268,827 | A | 12/1993 | Granneman et al. | 362/156 |
| 5,479,325 | A | 12/1995 | Chien | 362/105 |
| 5,567,040 | A | 10/1996 | Tabanera | 362/108 |
| 5,570,945 | A | 11/1996 | Chien et al. | 362/84 |
| 5,676,451 | A | 10/1997 | Tabanera | 362/156 |
| 5,794,366 | A * | 8/1998 | Chien | 40/540 |
| 5,829,063 | A | 11/1998 | Cheng | 2/209.13 |
| 5,836,671 | A | 11/1998 | Chien | 362/84 |
| 5,845,987 | A | 12/1998 | Painter | 362/206 |
| 5,865,523 | A | 2/1999 | Chien | 362/84 |
| 6,116,745 | A | 9/2000 | Yei | 362/105 |
| 6,167,570 | B1 | 1/2001 | Su | 2/209.13 |
| 6,309,764 | B1 | 10/2001 | Burrows | 428/690 |
| 6,585,390 | B1 | 7/2003 | Stone et al. | 362/156 |
| 6,874,904 | B1 * | 4/2005 | Hsu | 362/84 |
| 2001/0004808 | A1 | 6/2001 | Hurwitz | 36/137 |
| 2002/0093817 | A1 | 7/2002 | Stone et al. | 362/156 |
| 2003/0223225 | A1 | 12/2003 | Kurez et al. | 362/156 |

FOREIGN PATENT DOCUMENTS

JP 2002366066 * 12/2002

* cited by examiner

*Primary Examiner*—Ali Alavi
(74) *Attorney, Agent, or Firm*—Barnes and Thornburg LLP; Mark J. Nahnsen

(57) ABSTRACT

The present invention relates to electroluminescent bags that are comprised of a fabric material and is adapted for storing and transporting clothing, documents and the like or to be worn by the user. The electroluminescent bags are comprised of a unique electroluminescent panel and coaxial trim that are integrated into the fabric of the bag. The electroluminescent bag further comprises a battery pack with an inverter to allow the user to brightly illuminate the electroluminescent elements of the bag.

7 Claims, 6 Drawing Sheets

ELECTROLUMINESCENT BAGS

This application claims priority from U.S. Provisional Application Ser. No. 60/474,797 filed on May 30, 2003.

BACKGROUND

This disclosure relates to luggage, bags, jackets, caps and shoes and more specifically electroluminescent bags and apparel having electroluminescent elements integrated with the fabric of the bag or jacket to draw attention to the article for advertisement purposes and as an alert to others in low light conditions of the user's presence.

By way of background but not limitation, bags typically used for carrying goods such as clothing, paper, laptop computers and the like are fabricated out of fabric, leather, and vinyl, among others and may include a logo or reflective strips that require an outside light source to provide a reflective illuminating effect. Logos can also be in the form of cloth patches or embroidered on the bag. Jackets are worn for warmth and for appearance purposes. The design or logo can be used for advertisement, personal identification, or a combination of these or other functions. Articles, such as backpacks and soft briefcases are commonly seen by many people during a given day and typically include a logo or patchwork to advertise or promote a company name, product or design. The use of reflective material for the design or logo is only effective if a separate light source is applied to the logo, rendering the logo difficult to see or read in low light or artificial light conditions.

In view of the above, it should be appreciated that there is a need for an electroluminescent bag arrangement designed to attract attention and permit viewing of advertisement or designs in low light or artificial light conditions.

SUMMARY

The disclosure comprises electroluminescent bags and apparel that are comprised of a fabric material and are adapted for storing and transporting clothing, documents and the like or worn by the user. The electroluminescent bag and apparel are comprised of a unique electroluminescent panel and coaxial trim that are integrated into the fabric of the bag. Apparel may include caps, jackets and shoes, among others.

The electroluminescent bag and apparel further comprises a power source having a battery pack with an inverter to allow the user to brightly illuminate the electroluminescent elements. An electroluminescent patch is used and includes a first layer formed of an electroluminescent material that is cut to a desired shape and printed to include desired colors or designs. The first layer is connected to the bag material and a power source. A second layer is connected to the first layer and is molded to include desired patterns. The second layer includes translucent regions that permit light from the first layer to pass through the second layer. The second layer is also molded with opaque regions that do not allow light from the first layer to pass through the second layer. The second layer is molded to form ridges and can be molded in various colors to form a design. The second layer may also be printed to add additional colors or patterns to the top surface of the second layer.

The electroluminescent patch further includes a third layer positioned on the inside of the bag, adjacent to the first layer to reinforce the electroluminescent patch. The electroluminescent bag also includes electroluminescent piping positioned around the face of the bag that is connected to the power source so that it can be illuminated with the electroluminescent patch.

Other features and advantages of the disclosure will be set forth in part in the description which follows and the accompanying drawings, wherein the embodiments of the disclosure are described and shown, and in part will become apparent upon examination of the following detailed description taken in conjunction with the accompanying drawings.

BRIEF DESCRIPTION OF THE DRAWINGS

The above mentioned and other features of this disclosure and the manner of obtaining them will become more apparent and the disclosure will be best understood by reference to the following description of embodiments of the disclosure taken in conjunction with the accompanying drawings in which.

DETAILED DESCRIPTION

While the present disclosure will be described fully hereinafter with reference to the accompanying drawings, in which a particular embodiment is shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

Figure 1:
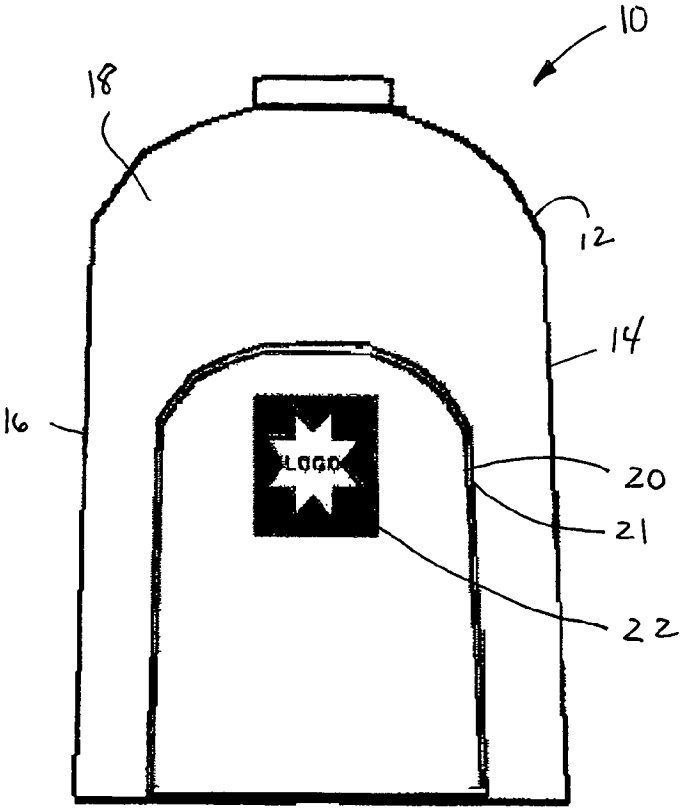
FIG. 1 is a front view of a bag illustrating the electroluminescent patch and coaxial trim.
Figures 3, 4, 5:
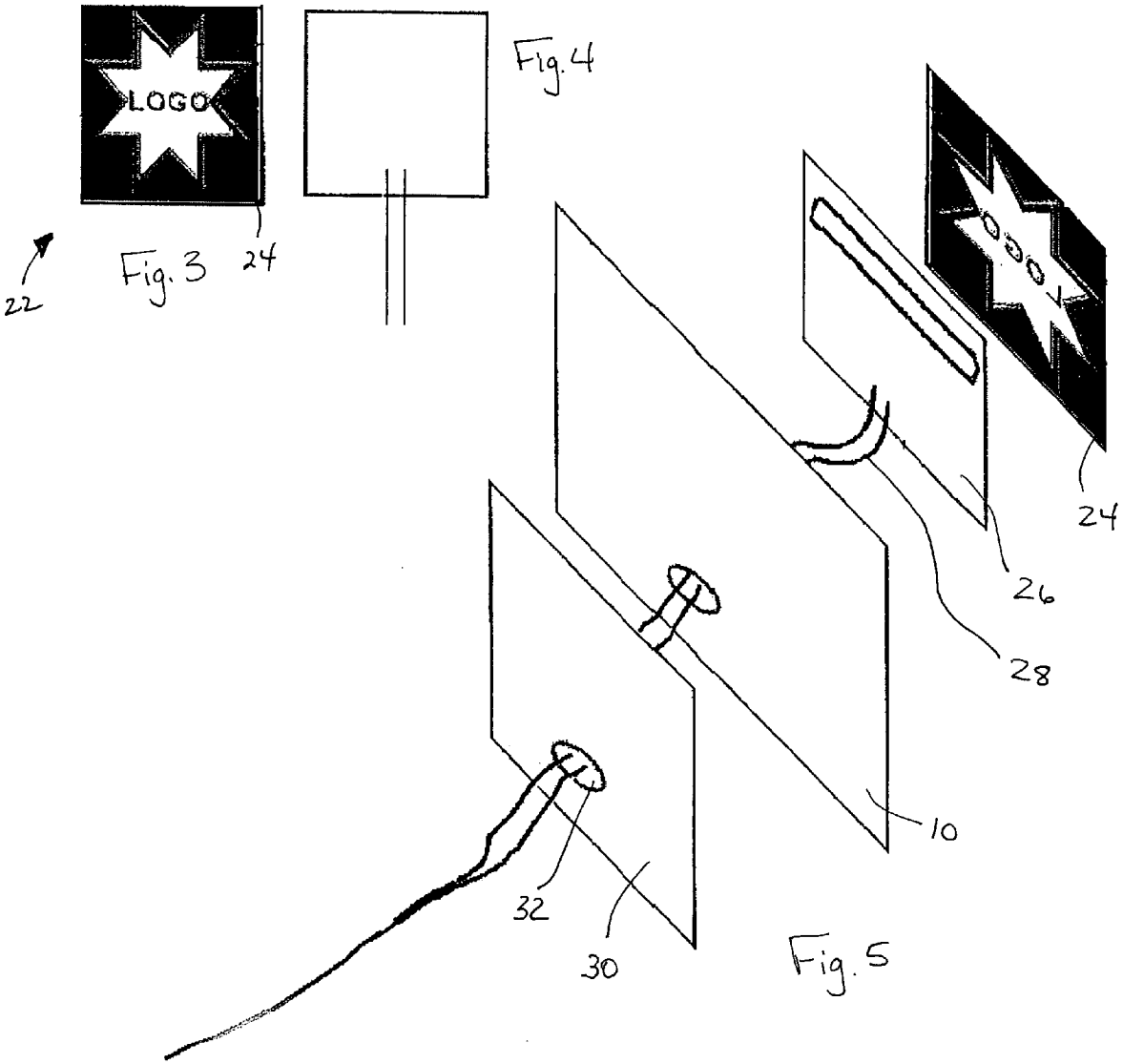
FIG. 3 is a front view of an electroluminescent patch element.
FIG. 4 is a rear view of the electroluminescent patch element.
FIG. 5 is an exploded view of the electroluminescent patch element.

In the figures, like reference numerals indicate the same elements throughout. FIG. 1 illustrates a front view of the electroluminescent bag 10 having a back panel 12, side panels 14 and 16 and a front wall panel 18, which are connected together along their peripheries by stitching. The electroluminescent bags 10 may also be in the form of apparel such as caps, shoes and jackets. The electroluminescent bag 10 also includes transparent or semi-transparent polymer piping 20, such as PVC, that is threaded to the intersections of the front 18 and side 14 and 16 panels. The piping 20 includes a coaxial, flexible electroluminescent source 21 that passes through the center of the piping 20. The flexible electroluminescent source 21 may include color tinting such that light of a desired shade is emitted which passed through the piping 20. This piping 20 may also be encased in a polymer film or sheeting to increase the region of illumination.

The front panel 18 of the electroluminescent bag 10 includes an electroluminescent patch 22 that is affixed to the front panel 18 or side panels 14, 16 by means of stitching, heat or sonic seal. The electroluminescent patch 22 is molded or formed from micro-injected rubber, PVC, silicon or other polymer.

The electroluminescent patch 22 may include an etched and/or a lenticular finish, and contains transparent and semi-transparent layers in its construction. Positioned in a layer behind the printed front patch layer 24 is an electroluminescent layer 26 that is die-cut and affixed to the front patch layer 24. The electroluminescent layer 26 of the electroluminescent patch 22 may be printed or unprinted and serves as a backlight to evenly illuminate a specific area or areas of the front patch layer 24. The electroluminescent layer 26 provides the backlighting with lower power drain through the transparent or semi-transparent elements of the electroluminescent patch 22.

The front patch layer 24 is hot stamp molded or made by a micro injection molding process. The front patch layer 24 is molded to include ridges, definition lines and peaked regions which permit various designs to be formed into the front patch layer 24. The front patch layer 24 when molded can include colored molding material so that the resultant patch layer 24 includes integrated color components. These color components can be translucent to permit light from the electroluminescent layer 26 to pass through the front patch layer 24.

The front patch layer 24 also includes one or more translucent regions and one or more opaque regions arranged in a desired pattern such that light from the electroluminescent layer 26 is permitted to pass through the front patch layer 24. The opaque region does not permit light to pass through the front patch layer 24. The front patch layer 24 is attached to the electroluminescent layer 26 by heat sealing around its perimeter.

The electroluminescent patch 22 is affixed to the front panel 18 of the electroluminescent bag 10 and positioned so as to cover an opening in the fabric which allows for the passage of a pair of conductors such as wires 28 to pass through for attachment to the electroluminescent patch 22. The wires 28 transmit current to the electroluminescent layer 26 of the patch 22 to cause illumination. Light created by the electroluminescent layer 26 is permitted to pass through the translucent portions of the front patch layer 24. When the patch 22 is observed by an individual, they see an illuminated pattern and/or logo designed to catch their eye to advertise a particular brand or goods.

To act as reinforcement to the electroluminescent patch 22, a rigid piece of PVC sheeting 30, or other polymer, is positioned behind the direct area of the material of the bag 10. The PVC sheeting 30 also includes an opening 32 to allow for the passage of the wires 28. The wires 28 are then coupled to one end of the electrode assembly of the electroluminescent source 21, and are routed to and threaded through the nearest opening of the polymer piping 20.

Figure 8:
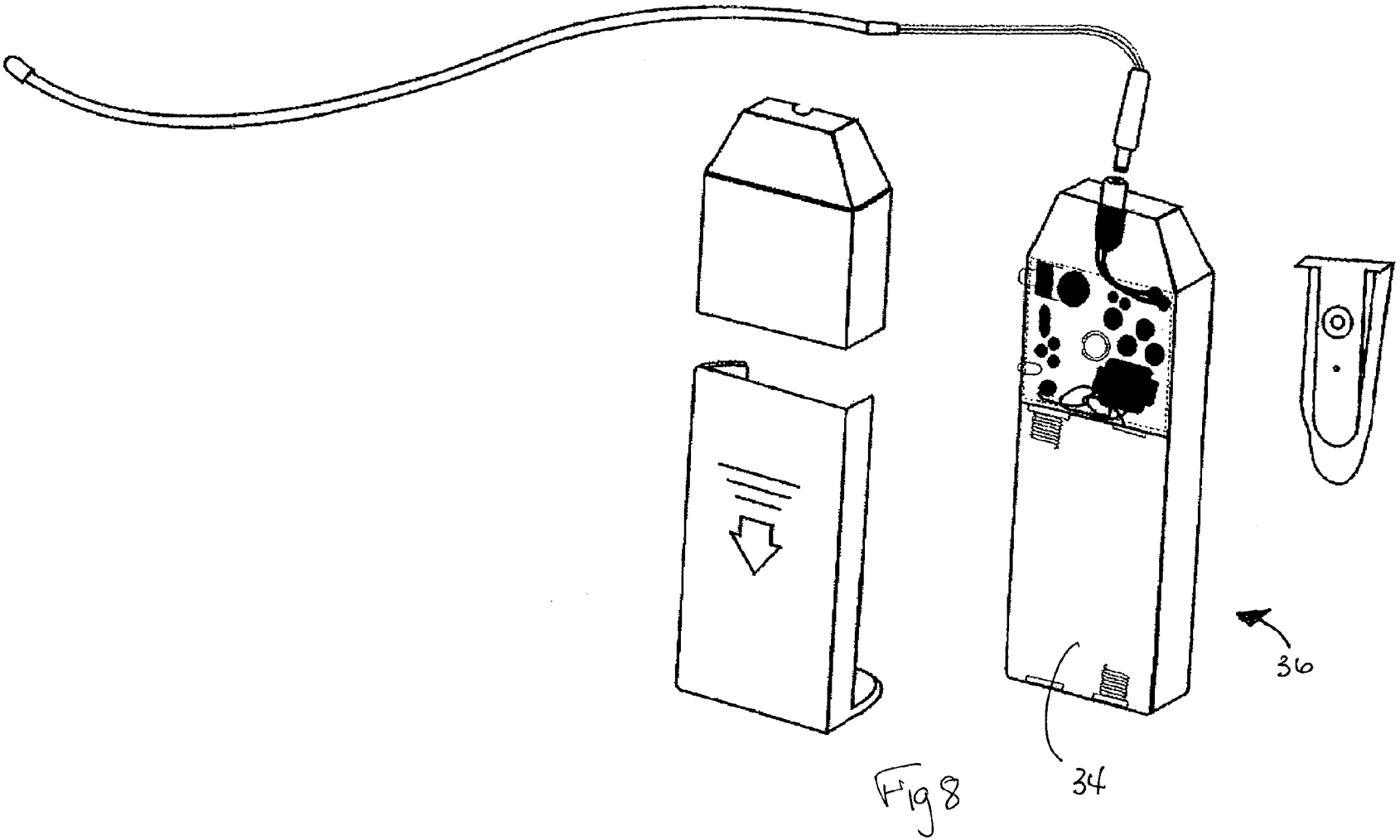
FIG. 8 is an exploded view of the power inverter for the electroluminescent bag.
Figure 9:
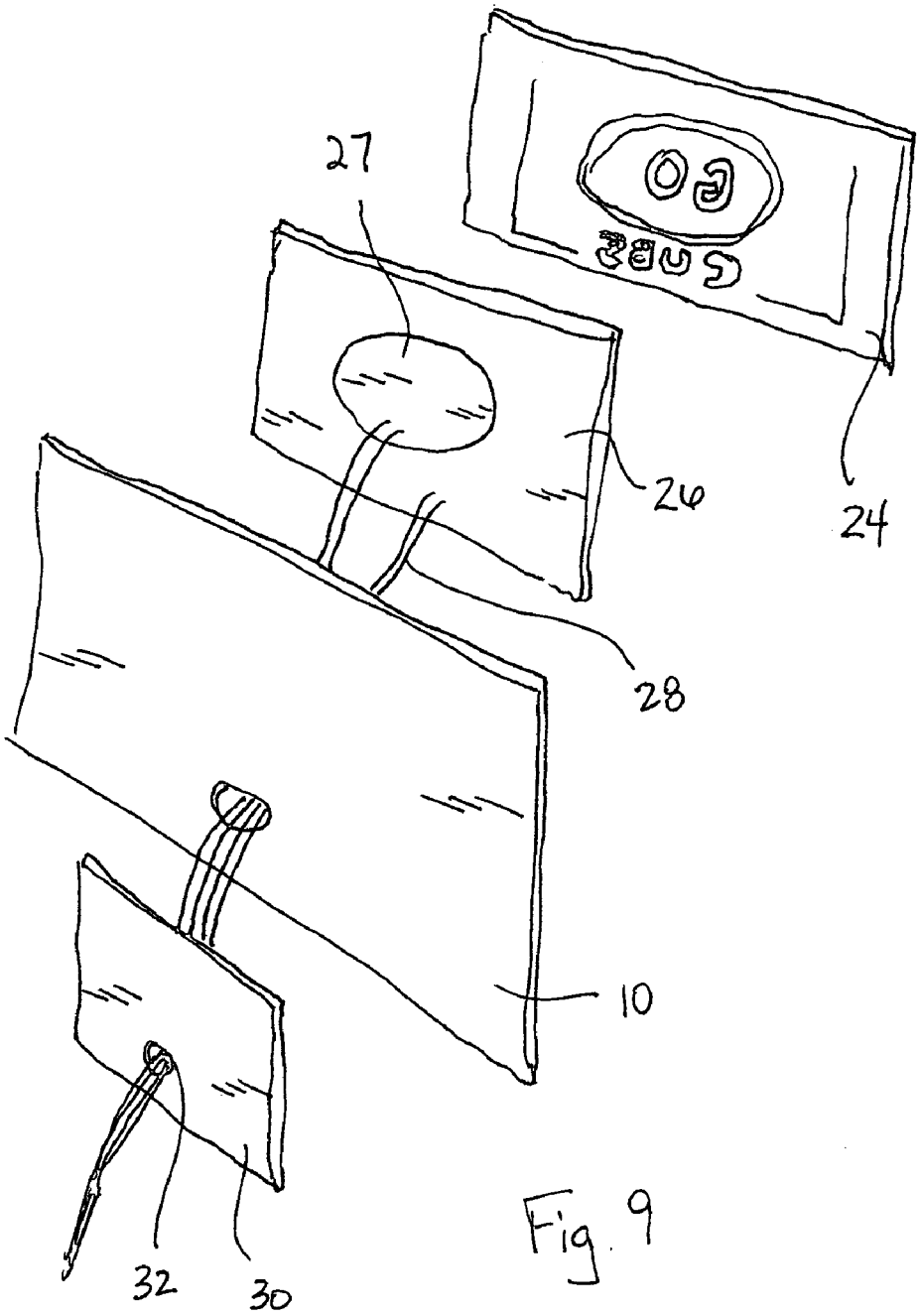
FIG. 9 is an exploded view of the electroluminescent patch element illustrating two electroluminescent layers.

The other end of the light source is again coupled to a conductor, such as wiring 28, which connects a battery pack 34 to an inverter 36, as shown in FIG. 8. The inverter 36 converts the direct current DC from the battery pack 34 to alternating current AC, to power the electroluminescent light sources. An electronic circuit transforms the direct current into alternating current, which is routed to the electroluminescent layer 26 and the electroluminescent source 21 used in the polymer piping 20.

The electroluminescent bag 10 further comprises a means for securing the battery pack 34 with the inverter 36 to the bag 10. The means for securing can be a separate compartment within the bag, on the outside of the bag or by using a fastener strap such as a hook and loop fastener. The current from the inverter 36 flows to the electroluminescent layer 26 and supplies power at a frequency high enough to brightly illuminate the electroluminescent layer 26 of the electroluminescent patch 22 and the polymer piping 20. The frequency of the current can be adjusted in the manufacturing process, determined as needed by the length of the coaxial, flexible electroluminescent source 21.

The electroluminescent bag 10 may further comprise a means for periodically interrupting the illumination produced by both the electroluminescent patch 22 and the polymer piping 20. A flash inverter circuit is provided to interrupt the transformed current supplied to the panel at periodic intervals, thereby interrupting the illumination produced. The flash inverter circuit is designed to cause the patch 22 and piping 20 to flash simultaneously or in an alternating fashion.

The electroluminescent patch 22 may also include a second electroluminescent layer 27, positioned adjacent to the first electroluminescent layer 26 so that independent light sources can be used to illuminate portions of the electroluminescent patch 22 at different times. For example, if the electroluminescent patch included the phrase "GO CUBS" the first electroluminescent layer 26 could be positioned under the word "GO" and the second electroluminescent layer 27 could be positioned under the word "CUBS" and timed to illuminate at a different time interval from the first electroluminescent layer 26 to create a desired alternating effect.

Referring to FIG. 1, the electroluminescent bag 10 is in the form of a backpack structure, which may be used to store and transport clothing, documents and like articles. Backpack structures are often used by a great many people abroad and are therefore seen in any public environment. Such a structure is particularly suited for displaying a design, name or other form of identification for personal or commercial use.

Figure 2:
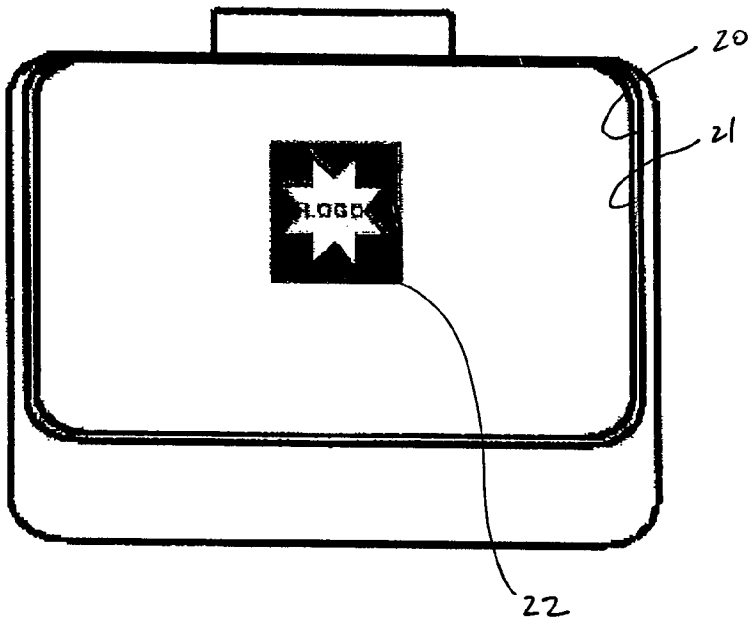
FIG. 2 is an alternate embodiment of the bag illustrating the electroluminescent patch and coaxial trim.

An advertisement or promotion placed on such an electroluminescent bag 10 can provide one with a means of displaying information to a large number of people at a relatively low cost, provided the desired logo or symbol can be applied efficiently to the bag structure in commercial quantities. Often, merchandise, such as that shown in FIGS. 1 & 2 can be given to individuals as promotional items, or sold as retail items thereby allowing the individual to use the article to advertise a product displayed in the design. This establishes recognition, unique individuality, and brand loyalty in the process.

Figure 6:
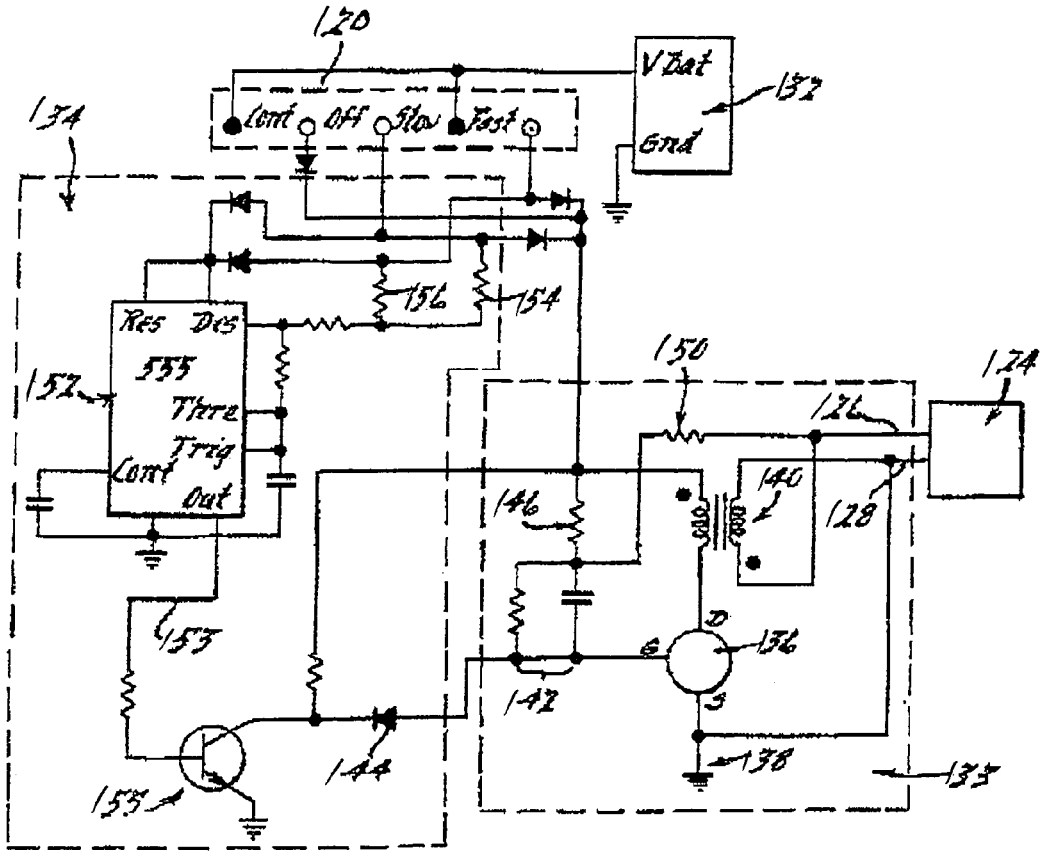
FIG. 6 is a wiring diagram for the electroluminescent bag.
Figure 7:
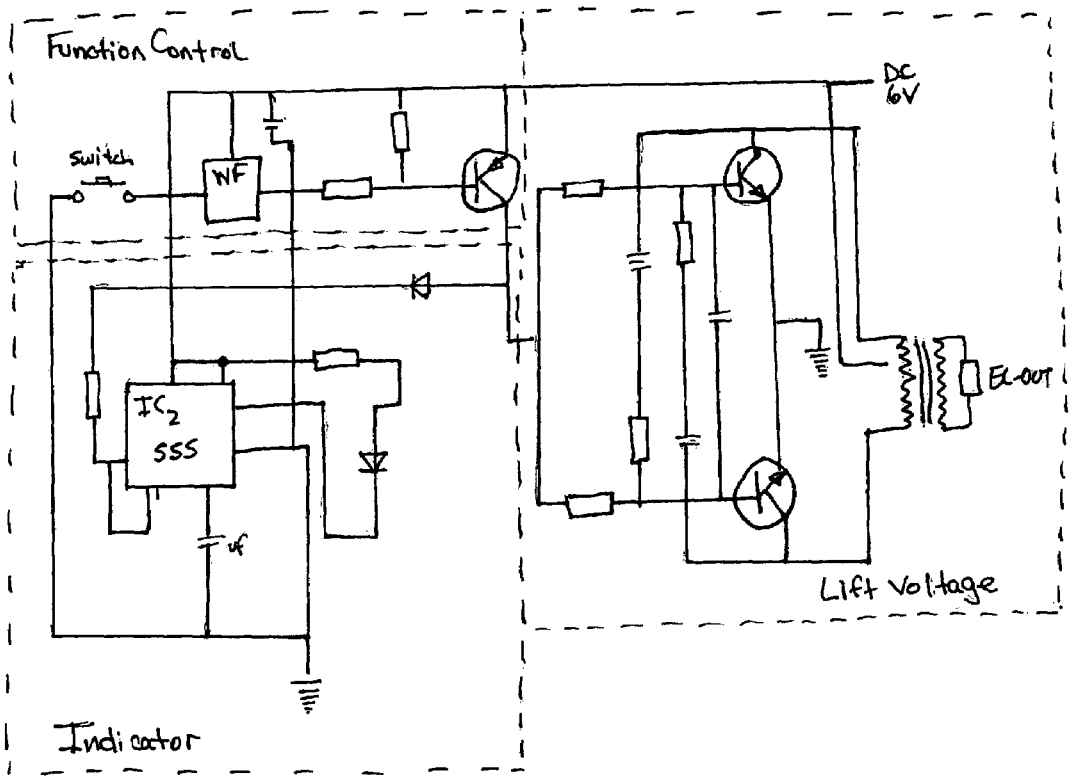
FIG. 7 is a wiring diagram for a battery pack for the electroluminescent bag.

Referring to the electronic circuit of FIG. 6, the design further comprises a DC to AC inverter circuit 133 and a flasher circuit 134. The electronic circuit also comprises a switch 120, an electroluminescent panel 124 and a battery 132. Inverter circuit 133 comprises switching transistor 136, preferably a very high gain FET device, such as 2N7000. The source of transistor 136 is grounded as 138, while the drain is coupled to a first primary lead of transformer 140.

The gate of transformer 136 is coupled to RC tank circuit 142. In the presently preferred embodiment, tank circuit 142 resonates at approximately 1200 Hz. Also coupled to the gate of transistor 136 via diode 144 is the flasher circuit 134. The flasher circuit 134 operates to periodically sort the gate to ground, thereby interrupting the oscillator circuit. The second primary lead of transformer 140 is coupled to a positive battery terminal. A first secondary lead of transformer 140 is coupled to conductor 126 of panel 124, while the second secondary lead of transformer 140 is grounded.

Preferably, transformer 140 provides a primary inductance of 0.0015 H and a secondary inductance of 4.2 H.

The tank circuit 142 is coupled through resistor 46 to the positive battery potential. Feedback resistor 150 is coupled between conductor 126 of panel 124 to cause the inverter circuit to continuously oscillate. The duty cycle of the output of timer 152 is selectively variable to alter the flash rate of the device. The duty cycle is altered using switch 120 which is a multi-position switch having four positions. In the first and second positions, switch 120 acts as an on/off switch by interrupting the battery potential to all circuits (first position—continuous on, second position—off). In a third position, switch 120 couples a first timing resistor 154 to the timer 152 to select a seven percent duty cycle, nominally. In a fourth position, switch 120 couples a second timing resistor 156 to the timer 152 to select a thirty percent duty cycle nominally.

In operation, inverter circuit 133 transforms the direct current of the battery 132 into alternating current at a potential substantially greater than the potential of the battery. In the preferred embodiment, battery 132 has a nominal potential of six volts, while inverter circuit 133 produces a quasi-sinusoidal current at a nominal potential of 130 volts RMS and at a frequency of approximately 1200 Hz.

When switch 120 is in the third position, flasher circuit 134 causes panel 124 to cyclically produce illumination for 90 mS and be off for 950 mS, nominally. When switch 120 is in the fourth position, flasher circuit 134 causes panel 124 to cyclically produce illumination for 90 mS and to be off for 150 mS, nominally.

The electroluminescent apparel is similar to the electroluminescent bag in that it includes an electroluminescent panel and coaxial trim that is integrated into the fabric of the apparel. The electroluminescent apparel further comprises a battery pack with an inverter to allow the user to brightly illuminate the electroluminescent elements.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. An electroluminescent bag comprising:

a bag portion having an opening, the bag portion including a strap;

an electroluminescent display panel connected to the bag portion, the electroluminescent display panel having a first layer, the first layer being made of an electroluminescent sheeting, the first layer including a printed coating;

a second layer attached to the first layer, the second layer molded to include a pattern, the pattern including light blocking regions and light penetrable regions;

a power source positioned within the bag portion, the power source connected to an inverter and a switch;

the first layer is connected to the power source by a conductor, the first layer is adapted to be illuminated when the switch is in the on position;

an electroluminescent wire positioned within a flexible, translucent tube, the tube adapted permit light generated by the electroluminescent wire to pass through the tube, the tube being attached to an area of the bag surrounding the electroluminescent display panel and connected to the power source.

2. The electroluminescent bag of claim 1, wherein the second layer includes a printed coating.

3. The electroluminescent bag of claim 1, wherein the tube is encased in a polymer sheeting.

4. The electroluminescent bag of claim 1, wherein a third layer, made from a electroluminescent material, is positioned adjacent to the first layer and adapted to be independently illuminated to permit the first and third layers to be illuminated at different times.

5. The electroluminescent bag of claim 1, wherein the first layer is attached to the second layer by heat sealing the layers about their perimeter.

6. The electroluminescent bag of claim 1, wherein the second layer is molded from PVC.

7. The electroluminescent bag of claim 1, further including a reinforcing layer positioned on the inside of the bag, the reinforcing layer adapted to reinforce the bag at the region surrounding the reinforcing layer.

* * * * *